US009284862B2

(12) United States Patent
Frey

(10) Patent No.: US 9,284,862 B2
(45) Date of Patent: Mar. 15, 2016

(54) MULTI-PART, JOINED ROTORS IN HYDRAULIC CAMSHAFT ADJUSTERS, HAVING JOINT-SEALING PROFILES, AND METHOD FOR PRODUCING THE ROTORS

(71) Applicant: GKN SINTER METALS HOLDING GMBH, Radevormwald (DE)

(72) Inventor: Sascha Frey, Troisdorf (DE)

(73) Assignee: GKN Sinter Metals Holding GmbH, Radevormwald (DE)

( * ) Notice: Subject to any disclaimer, the term of this patent is extended or adjusted under 35 U.S.C. 154(b) by 0 days.

(21) Appl. No.: 14/267,499

(22) Filed: May 1, 2014

(65) Prior Publication Data

US 2014/0238325 A1 Aug. 28, 2014

Related U.S. Application Data

(63) Continuation of application No. PCT/EP2012/004598, filed on Nov. 5, 2012.

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2820/01* (2013.01); *Y10T 29/49293* (2015.01)

(58) Field of Classification Search
CPC ..... F01L 1/3442; F01L 2001/34479; F01L 2001/34423
USPC ..... 123/90.17, 90.15; 464/160, 161
See application file for complete search history.

(56) References Cited

U.S. PATENT DOCUMENTS

| | | | | |
|---|---|---|---|---|
| 7,640,902 | B2 * | 1/2010 | Knecht et al. | 123/90.17 |
| 8,550,046 | B2 * | 10/2013 | Terfloth et al. | 123/90.17 |
| 2008/0254900 | A1 | 10/2008 | Urckfitz | |
| 2008/0289596 | A1 | 11/2008 | Borraccia | |
| 2011/0126785 | A1 * | 6/2011 | Terfloth et al. | 123/90.15 |

FOREIGN PATENT DOCUMENTS

| | | | |
|---|---|---|---|
| DE | 10 2005 026553 | B3 | 9/2006 |
| DE | 10 2008 028640 | A1 | 12/2009 |

(Continued)

OTHER PUBLICATIONS

International Search Report under date of Apr. 18, 2013 in connection with PCT/EP2012/004598.

*Primary Examiner* — Jesse Bogue
*Assistant Examiner* — Daniel Bernstein
(74) *Attorney, Agent, or Firm* — Quarles & Brady LLP

(57) ABSTRACT

The invention relates to a camshaft adjusting device (1) for an internal combustion engine and to a method for producing a camshaft adjusting device having a stator wheel (10) and a rotor wheel (11), wherein the rotor wheel (11) has a first body part (19) and a second body part (20), wherein a joining surface (19*a*) of the first body part (19) and a joining surface (20*a*) of the second body part (20) are joined to one another, and wherein depressions (21, 22) are formed in at least one of the joining surfaces (19*a*, 20*a*) in order to form the fluid ducts (17, 18) at least in sections. In order to provide a camshaft adjusting device (1) with an improved rotor wheel (11), which is formed from two body parts (19, 20), which can be joined to one another in an improved manner, a provision according to the invention is that at least one sealing means (25, 26) be provided in or on at least one joining surface (19*a*, 20*a*) with the sealing means being designed such that the fluid ducts (17, 18) are sealed off and that defined contact is obtained between the joining surfaces (19*a*, 20*a*), which are placed on top of one another.

10 Claims, 4 Drawing Sheets

(56) References Cited

FOREIGN PATENT DOCUMENTS

| | | | |
|---|---|---|---|
| DE | 102008028640 | A1 * | 12/2009 |
| DE | 10 2009 053600 | A1 | 5/2011 |
| DE | 10 2010 008006 | A1 | 8/2011 |
| JP | 2000 240414 | A | 9/2000 |

* cited by examiner

MULTI-PART, JOINED ROTORS IN HYDRAULIC CAMSHAFT ADJUSTERS, HAVING JOINT-SEALING PROFILES, AND METHOD FOR PRODUCING THE ROTORS

CROSS-REFERENCE TO RELATED APPLICATIONS

This application is a Continuation Application of PCT International Application No. PCT/EP2012/004598 filed on Nov. 5, 2012, and claims the benefit of German patent application no. 10 2011 117 856.6 filed on Nov. 8, 2011.

The present invention relates to a camshaft adjusting device for an internal combustion engine with a stator wheel and a rotor wheel functioning together with the stator wheel, in which the stator wheel is driven so as to rotate around an axis of rotation and in which the rotor wheel can be connected to a camshaft of the internal combustion engine, in which the stator wheel has stator vanes arranged so as to point radially inward, between which are rotor blades extended and arranged on the rotor wheel pointing radially outward, such that fluid chambers are formed between the stator vanes and the rotor blades, which can be exposed to pressurized fluid through the fluid ducts, and in which the rotor wheel has a first body part and a second body part, which are joined to one another with the respective joining surfaces placed together, and in which depressions are placed in at least one of the joining surfaces in order to form the fluid ducts, at least in sections. The invention further relates to a method for producing a camshaft adjusting device for an internal combustion engine.

DE 199 62 981 A1 discloses a camshaft adjusting device for an internal combustion engine. The camshaft adjusting device has a stator wheel characterized as the drive wheel and in which a rotor wheel is accommodated, which is characterized as the wheel hub. There is a plurality of blades extending radially toward the exterior on the wheel hub, which extend into the fluid chambers that are formed between the separation walls of the stator vanes that extend radially from the drive wheel toward the interior. The blades are thereby separated on a first side by a first fluid chamber and separated on an opposite, second side by a second fluid chamber. If a fluid chamber on a first side of the rotor blades is impacted with a higher fluid pressure than the fluid chamber on the second side, there is an angular torsion of the rotor wheel against the stator wheel around the axis of rotation of the camshaft adjusting device. The stator wheel is driven, for example, via a pulling mechanism, e.g. a chain or via a gear. In the exemplary embodiment shown, the drive wheel is separated by sidewalls and one sidewall has a sprocket around which a chain can be guided in order to drive the camshaft adjusting device around the axis of rotation so as to rotate.

In order to expose the fluid chambers shown to fluid pressure, for example from pressurized oil, fluid ducts are shown, which are characterized as pressure media ducts. The pressure media ducts are placed in the wheel hub through drilling processes, which results in disadvantages for the production of the camshaft adjusting device. In particular, the wheel hub and the drive wheel are often produced through sinter-metallurgical processes, which make the subsequent drilling processes difficult.

DE 10 2010 013 928 A1 describes a camshaft adjusting device with a rotor wheel through which fluid ducts extend radially in order to connect a hub-side fluid distribution compartment with the fluid chambers between the blades of the rotor wheel. In this process, it is stated that the long axial ducts shown, as well as the first and second radial ducts, are formed as bores in the material of the green body [0042]. Consequently, there are disadvantages that result when processing the green body as well, because the machine drilling of the green body causes disadvantages here as well.

Finally, DE 10 2008 028 640 A1 describes a camshaft adjusting device for an internal combustion engine with a stator wheel and a rotor wheel, in which the stator wheel is driven so as to rotate around an axis of rotation and in which the rotor wheel can be connected to a camshaft of the internal combustion engine. The stator wheel has body sections pointing radially inward, between which swiveling vanes, arranged on the rotor wheel, extend radially outward, such that working chambers are formed between the body sections and the swiveling vanes, which can be exposed to a pressurized fluid through the fluid ducts. The rotor wheel is formed by two body parts with respective joining surfaces, in which depressions have been placed, such that the fluid ducts can be formed through mutual joining of the body parts by means of the depressions. The disadvantage, however, is an undefined contact characteristic of the joining surfaces when the body parts are placed into contact with one another, because, due to tolerances of shape in the body parts produced usually through powder metallurgy, they often do not lie sufficiently flat against one another.

The object of the present invention is to obtain a camshaft adjusting device for an internal combustion engine that will overcome the disadvantages of the previously described prior art; particularly, the object is to obtain a camshaft adjusting device with an improved rotor wheel, which is formed from two body parts and which can be joined together in an improved manner.

This object is achieved, starting from a camshaft adjusting device according to the preamble of claim 1 and starting from a method according to the preamble of claim 14 with the respectively characterizing features. Advantageous further embodiments of the inventions are indicated in the respectively dependent claims.

The invention includes the technical teaching that at least one sealing means is provided in or on at least one joining surface with the sealing means being designed such that the fluid ducts are sealed off and defined contact is obtained thereby between the joining surfaces, which are placed on top of one another.

The invention is based on the idea of providing at least one sealing means in or on at least one joining surface in order to obtain defined contact between the joining surfaces and in order to seal off the fluid ducts from one another. In order to activate the camshaft adjusting device, a pressure means, particularly pressurized oil, is routed through the fluid ducts at an overpressure. Thus, particularly to seal off the fluid channels, sealing means are provided according to the invention, because effective sealing of the fluid ducts formed by the depressions merely from bringing the body parts together or via the joining surfaces is not achieved based on the undefined contact characteristic of the joining surfaces.

In particular, the shape deviation in the joining surfaces can prevent sealing if, for example, several micrometers of air remain between the separated areas of the joining surfaces. Only through the sealing means according to the invention, in or on at least one, but preferably on both, joining surfaces is this disadvantage overcome, and the sealing means results in defined contact between one of the joining surfaces lying opposite the sealing means and the sealing means itself.

According to a possible embodiment, the sealing means may have elevations that are arranged on at least one of the joining surfaces. The elevations may be plastically deformed during joining of the body parts, for example when they are pressed together in order to obtain a sealed contact with respect to the opposite joining surface, even when there are dimensional and positional tolerances in the joining surfaces and the elevations themselves. To this end, it may be particularly sufficient for the elevations to have a height of only a few tenths of a millimeter.

Furthermore, the sealing means may have the elevations in a first body part opposite the notches in the second body part, which are arranged on at least one of the joining surfaces and with which the elevations work together to have a sealing effect after the body parts are joined. The sealing connection between the elevations and the notches results particularly due to the fact that after the body parts are joined, the elevations can at least partially engage with the notches, for example without causing plastic deformation in the elevations with the joining. The joining can rather result in a tongue-and-groove joint whereby, in the end, a sealing effect of the depressions is achieved in a first joining surface opposite a second joining surface. The elevations can be designed geometrically in this case, to correspond to the notches, and the elevations can have, for example, a cross-sectional shape that corresponds to the cross-sectional shape of the notches.

According to a preferred potential exemplary embodiment, the elevations and the notches may directly border the depressions in the joining surfaces in their contour. In doing so, the elevations and the notches have a pattern that corresponds to the contour of the depressions in the joining surfaces through which the fluid ducts are formed. According to a further exemplary embodiment, the elevations and/or the notches, however, may also have a spacing to the depressions, and it may be sufficient to provide the elevations and/or notches merely between at least two depressions in the joining surface of the body parts. A plurality of fluid ducts in the rotor wheel can be separated and sealed off from one another with respect to fluids merely by the presence of the sealing means, regardless of the geometric pattern of the depressions in the joining surfaces.

For example, the elevations and/or the notches may have a height and a depth of 0.5 mm to 2 mm and preferably 1 mm, respectively, in which the elevations and/or the notches may be placed into the sintered component, particularly through a pressing process. In particular, the elevations and/or the notches may be placed in the green body of the sintered component through a pressing process.

With yet further advantage, the elevations with the notches may work together such that a positioning of the body parts with respect to one another is enabled through engagement of the elevations into the notches, in which a preferably mechanically loadable connection is formed between the body parts particularly through the engagement of the elevations into the notches. A positioning aid of the body parts can be formed with respect to one another due to the presence of the elevations and the notches formed, corresponding to the elevations on the opposite body part. In particular, the body parts can be inserted on top of one another, and the arrangement of the elevations and the arrangement of the notches, corresponding to the elevations on the opposite body part, can be provided such that the body parts can be placed in their required rotational position on top of one another. The joining surfaces cannot be placed completely together until the body parts have been placed in a correct position with respect to one another, because only then are the elevations in the opposite position with respect to the notches and able to engage with them. Flat contact between the two joining surfaces can be achieved once the elevations have engaged the notches.

The elevations and/or the notches may be placed in a green body of a body part produced from a sintered component; in particular, the elevations may be formed as a single piece and from a single material with the body part.

It is further advantageous if the elevations and the notches, individually or together, are formed as deformable, particularly plastically deformable, joining profiles. For example, the elevations may have an excess lateral dimension with respect to the notches, which means that the elevations have to be pressed into the notches when the body parts are placed on top of one another until the joining surfaces lie flat against one another. The sealing effect of the elevations engaging into the notches is improved, in particular, when the elevations are subjected to at least a slight plastic deformation when they are pressed into the notches.

It is particularly advantageous if the axis of rotation of the rotor wheel forms a surface normal on the joining plane of the body parts. The joining plane in this case corresponds to the plane of extension of the joining surfaces of the body parts placed on top of one another. Alternatively, the rotor wheel may also be formed from multiple parts, and the respective planes of division of the body parts may extend, for example, radially between the rotor blades.

Also advantageous is for the rotor wheel to be formed from a component produced from powder metallurgy; in particular, at least one, or preferably both, body parts may be a component, particularly a sintered component, produced from powder metallurgy. To produce a rotor wheel for a camshaft adjusting device, a powder metallurgy method is preferably suitable in order to achieve the required strength properties of the component and avoid machining of the component, which is costly. If the rotor wheel is provided from a sintered component, the advantages of production of the fluid ducts according to the invention may be especially advantageously utilized through depressions in the blade surfaces, because they do not have to be machined.

For powder metallurgical production of sintered components, initially a green body is pressed, which already has the geometric shape of the component to be created. The green body is then sintered. Thus, it is especially advantageous if the depressions in the joining surfaces of the sintered components are already in the green bodies for producing the body parts. The depressions may preferably be placed through a pressing process.

The rotor wheel may have fluid distribution compartments, in which the fluid ducts between the fluid distribution compartments and allocated fluid chambers extend at least partially radially through the rotor wheel. The fluid distribution compartments may be formed inside the hub of the rotor wheel, which means that the fluid ducts extend radially between the inside of the hub and the fluid chambers. A further fluid distribution compartment may be provided planar-side on the hub of the rotor wheel, and the fluid ducts may have a radial extension via a first section and an axial extension via a second section through the base body of the rotor wheel. The depressions may be placed in the joining surfaces such that the fluid ducts extending radially through the depressions formed continue into the axial section.

The object of the present invention is further achieved by a method for producing a camshaft adjusting device for an internal combustion engine with a stator wheel and a rotor wheel functioning together with the stator wheel, in which the stator wheel is driven so as to rotate around an axis of rotation and in which the rotor wheel can be connected to a camshaft of the internal combustion engine, in which the stator wheel has stator vanes arranged so as to point radially inward, between which rotor blades are extended and arranged on the rotor wheel pointing radially outward, such that fluid chambers are formed between the stator vanes and the rotor blades.

The rotor wheel is formed from a first and a second body part, in which the body parts are joined together with respective joining surfaces placed together and in which depressions are placed in at least one of the joining surfaces in order to form fluid ducts, at least in sections. The fluid chambers may be exposed to a pressurized fluid through the fluid ducts. According to the invention, the method comprises the steps of providing at least one sealing means in or on at least one joining surface, such that the fluid ducts are sealed off, such that defined contact is obtained between the joining surfaces placed on top of one another, and such that joining of the body parts is ensured through placement of the joining surfaces on top of one another. Finally, the fluid ducts are formed by the depressions through the joining of the body parts. When joining the body parts through placing the joining surfaces on top of one another, the depressions, which are open on one side, and which are formed, for example, in the shape of a U, are sealed off to the opposite surface. It is also possible to place depressions in both joining surfaces, which form the fluid ducts in an opposite arrangement when the joining surfaces are placed on top of one another, in order to enlarge, for example, the flow cross-section in the fluid ducts.

The method comprises, in particular, the placement of sealing means in the form of elevations and notches on an opposite joining surface. The elevations and/or the notches are already in the body parts during their production, and the body parts are produced through a powder metallurgical sintering process. In this process, initially green bodies of the body parts are produced in which the elevations and/or the depressions are placed in the green bodies, for example, through a pressing process, or are placed in them directly during pressing of the green body.

The aforementioned features and advantages of the camshaft adjustment device may also be considered for the method according to the invention for producing the camshaft adjusting device.

Further measures improving the invention are shown in greater detail together with the description of a preferred exemplary embodiment of the invention by means of the figures. The following is shown:

Figure 3A:
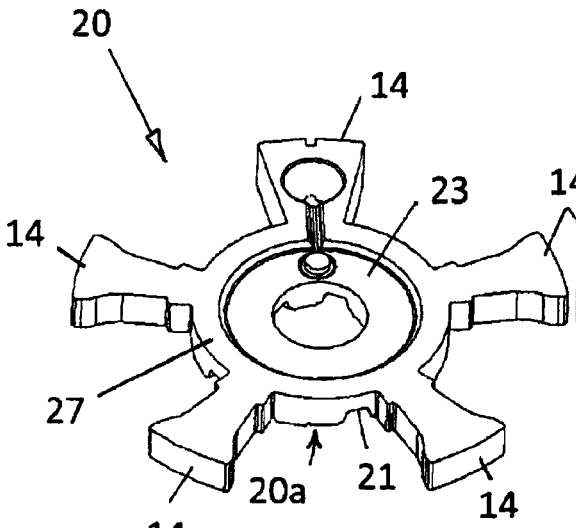
Figure 3B:
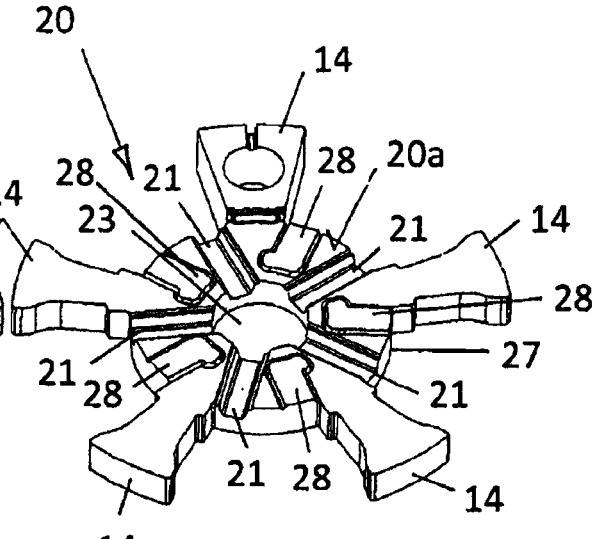
Figure 4A:
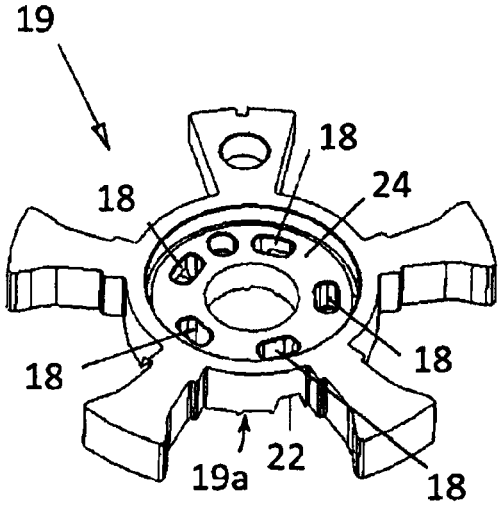
Figure 4B:
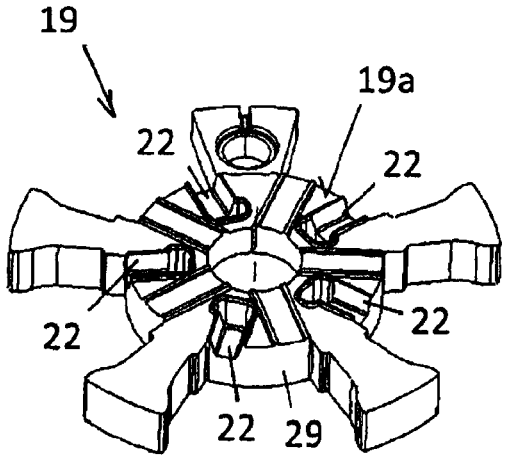

FIG. 3*a* shows a first body part of a rotor wheel in a first view;

FIG. 3*b* shows the first body part of the rotor wheel according to FIG. 3*a* in another view;

FIG. 4*a* shows a second body part of the rotor wheel in a first view;

FIG. 4*b* shows the second body part of the rotor wheel according to FIG. 4*a;*

Figure 1:
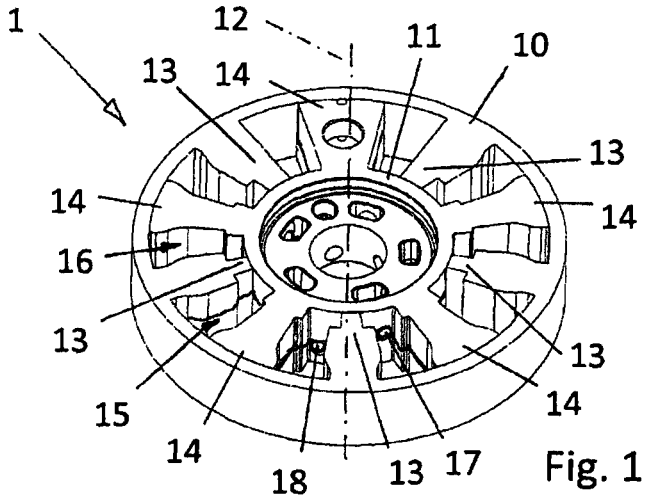
FIG. 1 shows a perspective view of a camshaft adjusting device.
Figure 5:
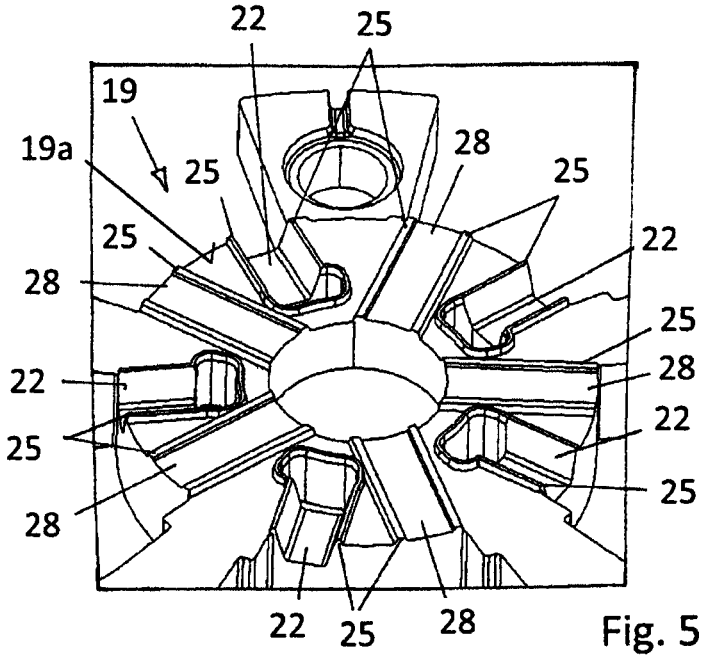
Figure 6:
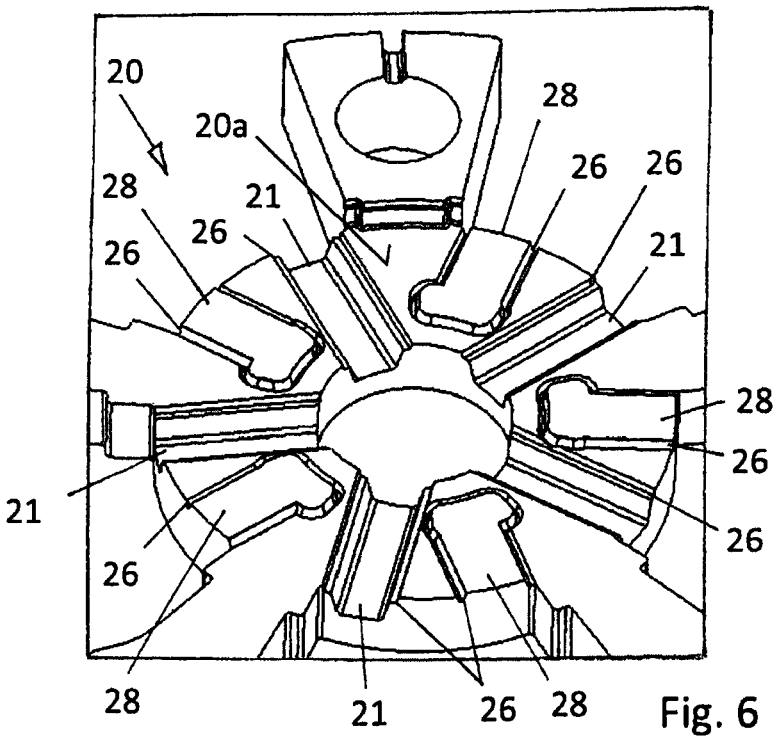
Figure 7:
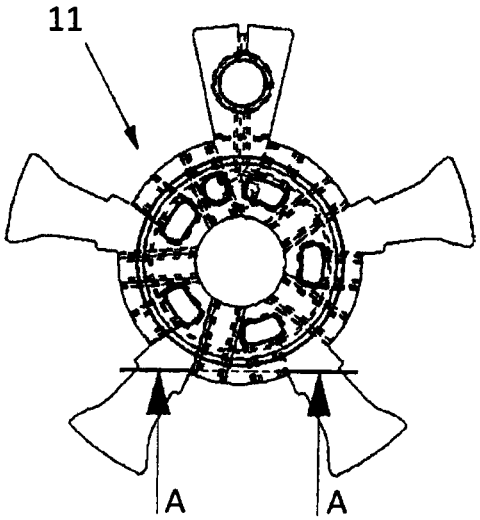
Figure 8:
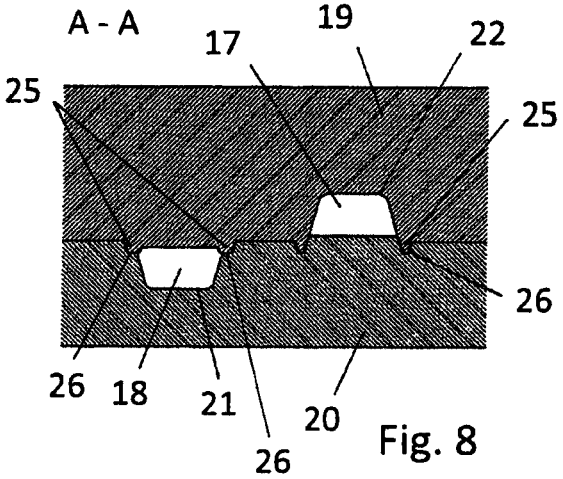
Figure 9:
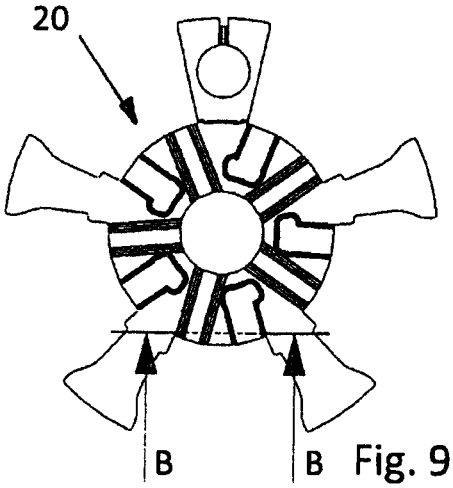
Figure 10:
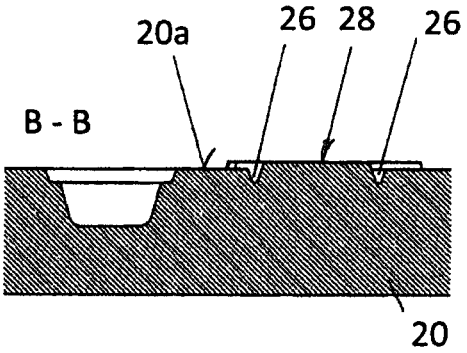

FIG. 5 shows a perspective partial view of a body part of the rotor wheel with depressions for forming the fluid ducts;

FIG. 6 shows a partial view of another body part with the fluid ducts;

FIG. 7 shows the top view of the camshaft adjusting device with a cutting plane line shown;

FIG. 8 shows the sectional view through the camshaft adjusting device according to the cutting plane line in FIG. 7;

FIG. 9 shows the top view of a body part with a cutting plane line shown; and FIG. 10 shows the sectional view through the body part according to the cutting plane line in FIG. 9;

FIG. 1 shows the example, in a perspective view, of a camshaft adjusting device 1, as it can be used for an internal combustion engine. The camshaft adjusting device 1 is essentially formed to be rotationally symmetric around an axis of rotation 12 and has a stator wheel 10 and a rotor wheel 11 functioning together with the stator wheel 10. The stator wheel 10 has five stator vanes 13 oriented toward the inside radially, and there are five rotor blades 14 arranged on the rotor wheel 11 oriented radially toward the outside. There are intermediate compartments formed between the stator vanes 13 into which the rotor blades 14 extend. This ensures that fluid chambers 15 and 16 are formed between the stator vanes 13 and the rotor blades 14, and the volume of a first fluid chamber 15 can be reduced while the volume of the opposite fluid chamber 16 can be increased during a relative rotation of the rotor wheel 11 opposite the stator wheel 10 around the axis of rotation 12. It is especially advantageous when the stator wheel and/or the rotor wheel are produced using powder metallurgy.

The fluid chambers, 15 and 16, may be exposed to a pressurized fluid through the fluid ducts, 17 and 18, and if, for example, a fluid chamber 15 is exposed to a fluid pressure, then, as a result, the volume of the fluid chamber 15 can be increased, while the volume of the fluid chamber 16 is simultaneously decreased. As a result, the fluid pressurization of fluid chambers 15 and 16 through fluid ducts 17 and 18 generates relative rotation between the rotor wheel 11 and the stator wheel 10. If the stator wheel 10 is driven, for example, through the crankshaft of the internal combustion engine via a pull mechanism, a camshaft that is put in connection with the rotor wheel 11 may lead or lag an angular position relative to the rotation of the crankshaft in order to thereby modify the valve control times in the internal combustion engine. The pressure impact for the camshaft adjustment device 1 shown takes place for all five fluid chambers 15 or all five fluid chambers 16 equally, and fluid ducts 17 and 18 are supplied for respective fluid chambers 15 and 16 through common fluid distribution compartments.

Figure 2:
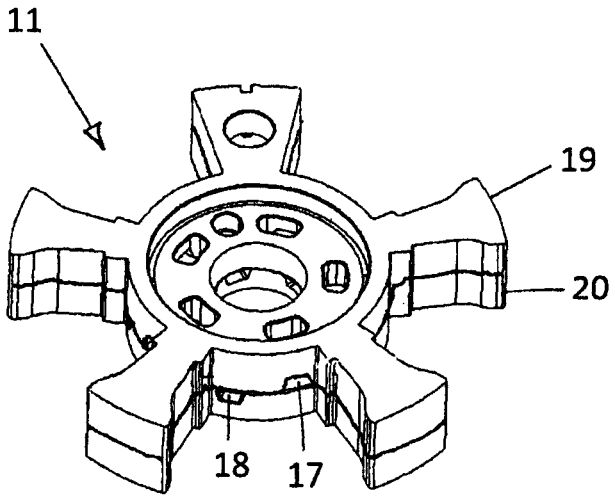
FIG. 2 shows a perspective view of a rotor wheel of the camshaft adjusting device according to FIG. 1.

FIG. 2 shows a perspective view of a rotor wheel 11 of a camshaft adjusting device 1, in which the rotor wheel 11 is formed from a first body part 19 and a second body part 20, and body parts 19 and 20 are arranged on top of one another via respective joining surfaces. Depressions are placed in the joining surfaces of body parts 19 and 20 through which fluid ducts 17 and 18 are formed, as is shown in greater detail in the other figures.

FIGS. 3*a* and 3*b* show a body part 20 for forming a rotor wheel 11 according to FIG. 2. FIG. 3*a* shows the body part 20 from a first side and FIG. 3*b* shows it from the opposite side. The body part 20 has a hub part 27, and five rotor blades 14 extend from the hub part 27 radially outward. Depressions 21 are placed on the joining surface 20*a* of the body part 20, which overlap with the joining surface 19*a* of the body part 19 (see FIGS. 4*a* and 4*b*). The depressions 21 extend radially between a fluid distribution compartment 23 in the center of the hub part 27 toward the outside in an area between the rotor blades 14, through which the subsequent fluid chambers 15 and 16 are formed. Adjacent to the depressions 21 are opposite surfaces 28 that cover the depressions 22 in the body part 19 when body parts 19 and 20 are placed flatly on top of one another with their joining surfaces, 19*a* and 20*a*.

FIGS. 4*a* and 4*b* show a front view and back view of body part 19. Depressions 22 have been placed in the joining surface 19*a*, which extend radially toward the outside over the joining surface 19*a* of the hub part 29. The body part 19 has a fluid distribution compartment 24 on an exterior side, and a plurality of fluid ducts 18 extend from the fluid distribution compartment 24, which open into the depressions 22 on the joining surface 19*a* of the body part 19.

Fluid distribution chambers 23 (see FIG. 3*b*) and 24 (see FIG. 4*a*) ensure that fluid chamber 15 is supplied via fluid distribution chamber 23 via fluid duct 17, which is formed by the depressions 21. Fluid distribution compartment 24 is used to supply the fluid chambers 16, which are connected to fluid distribution compartment 24 via the fluid ducts 18, and the fluid ducts 18 are formed by the depressions 22.

FIG. 5 shows a detailed view of the body part 19 and a plurality of depressions 22 are placed on the joining surface 19*a* of the body part 19. The depressions 22 have elevations 25 along the edge in order to form a sealing means 25. The elevations 25 protrude beyond the joining surface 19*a* and may be placed in the joining surface 19*a* through a pressing process during production of the body part 19 from a green body. Also shown are opposite surfaces 28 that are also edged with elevations 25.

FIG. 6 shows the body part 20 that can be joined to the joining surface 19*a* of the body part 19 via a joining surface 20*a*. Notches 26 have been placed in the joining surface 20*a*, and the elevations 25 in the body part 19 can engage with the notches 26 in the body part 20 when the body parts 19 and 20 are joined. This results in a sealing effect in the depressions 21 and 22 and the opposite surfaces 28 shown form fluid ducts 17 and 18 together with the opposite depressions 21 and 22 that are closed and sealed off by sealing means 25 and 26; see FIG. 2.

FIG. 8 shows a cross-section through the rotor wheel 11 according to cutting plane line A-A, as shown in FIG. 7. The cross-section along cutting plane line A-A shows a first fluid duct 18 that is formed by depression 21 in body part 20, and fluid duct 17 is formed by depression 22 in body part 19. To seal off fluid ducts 17 and 18, the body part 19 has elevations 25 that engage with the notches 26 that are placed in the body part 20. It is shown that the elevations 25 have the same cross-sectional shape as the notches 26 in order to form a corresponding sealing effect; alternatively, the cross-sectional shapes may also be different.

FIG. 10 shows a cross-section through body part 20 along cutting plane line B-B, as is shown in FIG. 9. The sectional view shows the opposite surface 28, which is bordered with notches 26. It is further shown that the opposite surface 28 is formed higher than the joining surface 20*a* of the body part 20. This improves the sealing effect for sealing off the opposite fluid duct 17; see FIG. 8.

The invention is not limited in its embodiments to the aforementioned preferred exemplary embodiment. Rather a number of variants are conceivable, which would make use of the solution shown, even with essentially different designs. All of the features and/or advantages, including design details, spatial arrangements, and process steps arising from the claims, the description, or the drawings, may be significant for the invention, alone or in various combinations.

REFERENCE LIST

1 Camshaft adjusting device
10 Stator wheel
11 Rotor wheel
12 Axis of rotation
13 Stator vane
14 Rotor blade
15 Fluid chamber
16 Fluid chamber
17 Fluid duct
18 Fluid duct
19 Body part
19*a* Joining surface
20 Body part
20*a* Joining surface
21 Depression
22 Depression
23 Fluid distribution compartment
24 Fluid distribution compartment
25 Sealing means, elevation
26 Sealing means, notch
27 Hub part
28 Opposite surface
29 Hub part

The invention claimed is:

1. A camshaft adjusting device for an internal combustion engine with a stator wheel and a rotor wheel functioning together with the stator wheel, wherein the stator wheel is driven so as to rotate around an axis of rotation, and wherein the rotor wheel can be connected to a camshaft of the internal combustion engine, wherein the stator wheel has stator vanes arranged so as to point radially inward, between which rotor blades extend, and the rotor blades are arranged on the rotor wheel pointing radially outward, such that fluid chambers are formed between the stator vanes and the rotor blades, which can be exposed to pressurized fluid through fluid ducts, and wherein the rotor wheel has a first body part and a second body part, which are joined to one another with the respective joining surfaces placed together, and wherein depressions are placed in at least one of the joining surfaces, in order to form the fluid ducts, at least in sections, characterized in that at least one sealing means is provided in or on at least one joining surface with the sealing means being designed such that the fluid ducts are sealed off and that defined contact is obtained between the joining surfaces, which are placed on top of one another wherein the sealing means in form of a peripheral sealing structure have elevations in a first body part on a first face side, opposite notches in an opposite second body part on a second face side opposite to the first face side, and with which the elevations function together to form a seal after the body parts are joined, and wherein the elevations and the notches are arranged on the side faces peripheral to the depressions, either to directly border the depressions in their contour or at a distance to the contour of the depressions surrounding the depressions on the face sides as the joining surface.

2. The camshaft adjusting device according to claim 1, characterized in that the elevations and/or notches have a height and a depth of 0.5 mm to 2 mm, respectively, and that the elevations and/or notches are placed in the sintered component through a pressing process.

3. The camshaft adjusting device according to claim 1, characterized in that the elevations function together with the notches such that positioning of the body parts with respect to one another is formed through engagement of the elevations into the notches, such that a mechanically loadable connection is formed between the body parts through the engagement of the elevations into the notches.

4. The camshaft adjusting device according to claim 1, characterized in that the elevations and/or the notches are placed in the green body of a body part produced from a sintered component, and the elevations are formed as a single part, and from one material, with the body part.

5. The camshaft adjusting device according to claim 1, characterized in that the elevations and/or the notches are formed as deformable joining profiles.

6. The camshaft adjusting device according to claim 1, characterized in that the axis of rotation forms a surface norm on the joining plane of the body parts.

7. The camshaft adjusting device according to claim 1, characterized in that at least the rotor wheel is formed from a sintered component produced from powder metallurgy.

8. The camshaft adjusting device according to claim 7, characterized in that the sintered component has a joining surface into which depressions are placed through a pressing process.

9. The camshaft adjusting device according to claim 1, characterized in that the rotor wheel has fluid distribution compartments, wherein the fluid ducts between the fluid distribution compartments and allocated fluid chambers extend at least partially through the rotor wheel.

10. A method to produce a camshaft adjusting device for an internal combustion engine with a stator wheel and a rotor wheel functioning together with the stator wheel, wherein the stator wheel is driven so as to rotate around an axis of rotation and wherein the rotor wheel can be connected to a camshaft of the internal combustion engine, wherein the stator wheel has stator vanes arranged so as to point radially inward, between which rotor blades extend and the rotor blades are arranged on the rotor wheel pointing radially outward, such that fluid chambers are formed between the stator vanes and the rotor blades, which can be exposed to pressurized fluid through fluid ducts, and wherein the rotor wheel is provided by a first body part with a first joining surface and by a second body part with a second joining surface, wherein depressions are placed in at least one of the joining surfaces, in order to form the fluid ducts, at least in sections, wherein the method comprises at least the following steps:

Provision of at least one sealing means in or on at least one joining surface with the sealing means being designed such that the fluid ducts are sealed off and that defined contact is obtained between the joining surfaces, which are placed on top of one another wherein the sealing means is in the form of a peripheral sealing structure having elevations in a first body part on a first face side and having opposite notches in an opposite second body part on a second face side opposite to the first face side and wherein the elevations and the notches are arranged on the side faces peripheral to the depressions, either to directly border the depressions in their contour or at a distance to the contour of the depressions surrounding the depressions on the face sides as the joining surfaces and Joining of the body parts by placing the joining surfaces on top of one another such that the elevations and the notches function together to form a seal after the body parts are joined.

* * * * *

UNITED STATES PATENT AND TRADEMARK OFFICE

CERTIFICATE OF CORRECTION

PATENT NO. : 9,284,862 B2
APPLICATION NO. : 14/267499
DATED : March 15, 2016
INVENTOR(S) : Sascha Frey It is certified that error appears in the above-identified patent and that said Letters Patent is hereby corrected as shown below:

In the Claims

Col. 8, Line 44, Claim 1, change “surface” to --surfaces--.

Signed and Sealed this
Seventeenth Day of May, 2016

Michelle K. Lee

Michelle K. Lee
*Director of the United States Patent and Trademark Office*